United States Patent [19]

Van Horssen

[11] Patent Number: 4,967,614

[45] Date of Patent: Nov. 6, 1990

[54] APPARATUS FOR INSTALLING CLEAT ON GOLF SHOE

[76] Inventor: Charles A. Van Horssen, 9233 N. 12th Ave., Phoenix, Ariz. 85021

[21] Appl. No.: 370,840

[22] Filed: Jun. 23, 1989

[51] Int. Cl.[5] ..... B25B 23/16

[52] U.S. Cl. ..... 81/176.15; 81/177.8

[58] Field of Search ..... 81/176.15, 177.7, 177.8, 81/177.9

[56] References Cited

U.S. PATENT DOCUMENTS 2,881,648 4/1959 Hottle ..... 81/176.15

FOREIGN PATENT DOCUMENTS 0027878 6/1921 Denmark ..... 81/177.8

*Primary Examiner*—Frederick R. Schmidt

*Assistant Examiner*—Lawrence Cruz

*Attorney, Agent, or Firm*—Tod R. Nissle

[57] ABSTRACT

Apparatus for installing a cleat on the sole of a golf shoe. The cleat includes a pair of apertures which each open outwardly away from the sole of the golf shoe and includes an externally threaded screw on the back of the cleat which turns into an internally threaded aperture formed in the sole of the golf shoe. The apparatus includes a pair of feet each shaped to engage the cleat by fitting in one of the cleat apertures. The apparatus is rotated to turn the cleat and rotate the externally threaded cleat screw into the internally threaded sole aperture. While the apparatus is being rotated, it can be tilted with respect to the sole of the golf shoe without causing either of the cleat—engaging feet to lift free from its associated aperture in the cleat.

1 Claim, 1 Drawing Sheet

APPARATUS FOR INSTALLING CLEAT ON GOLF SHOE

This invention pertains to apparatus for installing a cleat on the sole of a golf shoe.

More particularly, the invention pertains to apparatus which includes a pair of feet for engaging and turning a cleat into an internally threaded aperture formed in the sole of the golf shoe, the cleat including a pair of apertures which each open outwardly away from the sole of the golf shoe and removably receive one of said feet, the feet being manually rotated about the center of the cleat to turn an externally threaded screw on the back of the cleat into the internally threaded aperture formed in the sole of the golf shoe.

In a further respect, the invention pertains to cleat installation apparatus of the type described which can be tilted with respect to the sole of the golf shoe without causing either of the cleat—engaging feet to lift free from its associated aperture in the cleat.

The circular cleats which are installed on the sole of a conventional golf shoe include an externally threaded screw portion attached to the center of the back surface of the cleat. The front side of the cleat includes an outwardly extending ground engaging tip. A pair of spaced apart outwardly opening apertures are formed in the cleat along a straight line extending over the front surface of the cleat through the ground engaging tip. Each aperture removably receives one of the two feet which are formed on the well known unitary hand held tool for installing cleats on or removing cleats from the sole of a golf shoe. This unitary tool comprises a thin rigid panel of metal. The feet are formed along the lower edge of the metal panel, are sized to fit into the cleat apertures, and are spaced apart a distance equal to the distance that the cleat apertures are spaced apart. To use the unitary tool the feet are inserted in the cleat apertures and the tool is manually turned such that the feet bear against the cleat apertures and cause the cleat to rotate. When the cleat rotates, the externally threaded screw on the back of the cleat turns into or out of the internally threaded aperture in the sole of the golf shoe.

Several disadvantages are associated with the use of the conventional unitary cleat installation and removal tool. First, if a cleat is tightly secured in the sole of a golf or other shoe, utilizing the conventional unitary tool requires that an individual have a substantial amount of muscular strength in the hand turning the tool. Even if the individual has sufficient strength to turn the tool, the force manually applied to the tool may shear the feet from the tool, requiring the acquisition of a new replacement tool. Second, if after the feet on the unitary tool are inserted in the apertures formed in the cleat, the tool is slightly tilted, one of the feet on the tool can lift free from its associated aperture in the cleat, causing the tool to loose its rotational engagement with the cleat. In order for a foot to lift free from its associated cleat aperture, the unitary tool must be tilted in a reference plane which passes through the cleat apertures, the ground engaging cleat tip, and through the flat face of the tool. When the unitary tool is being utilized, it is a simple matter to inadvertently tilt the tool in this reference plane.

Accordingly, it would be highly desirable to provide an improved apparatus for turning a cleat into and out of the sole of a shoe, the improved apparatus enabling individuals with minimal hand strength to readily remove a cleat tightly secured in the sole of a shoe and enabling the improved apparatus to be tilted without causing one of the cleat engaging feet on the apparatus to lift free from the cleat.

Therefore, it a principal object of the invention to provide improved apparatus for turning a cleat into and out of the sole of a golf shoe.

A further object of the invention is to provide improved apparatus for manually installing a cleat in the sole of a golf shoe, the apparatus permitting the user to laterally move, with respect to the sole of the shoe, the hand manipulating the apparatus without causing one of the cleat engaging feet on the apparatus to lift free from contact with its associates cleat aperture.

Still another object of the invention it to provide improved cleat installation apparatus which can be readily utilized by an individual having minimal manual muscular strength and having minimal ability to use conventional hand tools.

These and other, further and more specific objects and advantages of the invention will be apparent to those skilled in the art from the following detailed description thereof, taken in conjunction with the drawings, in which.

Briefly, in accordance with my invention, I provide an improvement used in combination with a shoe. The shoe includes at least one cleat rotatably affixed to the sole of the shoe. The cleat is rotated about a selected axis when it is secured to the sole. The cleat includes a pair of apertures each spaced away from the axis and opening outwardly away from the sole. The selected axis is at an angle to the sole. The improvement comprises tool means for turning the cleat. The tool means includes a cleat engaging structure including a pair of feet each received by an opposite one of said pair of cleat apertures, and a peripheral portion connected to said feet; a body including a groove receiving at least a part of the peripheral portion; and, means for turning the body to rotate the feet about the selected axis to turn the cleat. The groove is shaped and dimensioned such that turning the body presses at least a portion of the groove against at least a part of the peripheral portion to generate forces transverse the axis and acting against the part of the peripheral portion to generate twisting forces on the cleat engaging structure, and, through the feet, on the pair of apertures and the cleat and, such that the groove contacts and can move over the peripheral portion along an arcuate path of travel lying in a flat plane such that the body can tilt with respect to the sole and cleat engaging structure while the feet remain in the cleat apertures. The flat plane is at an angle with respect to the sole.

Figure 1:
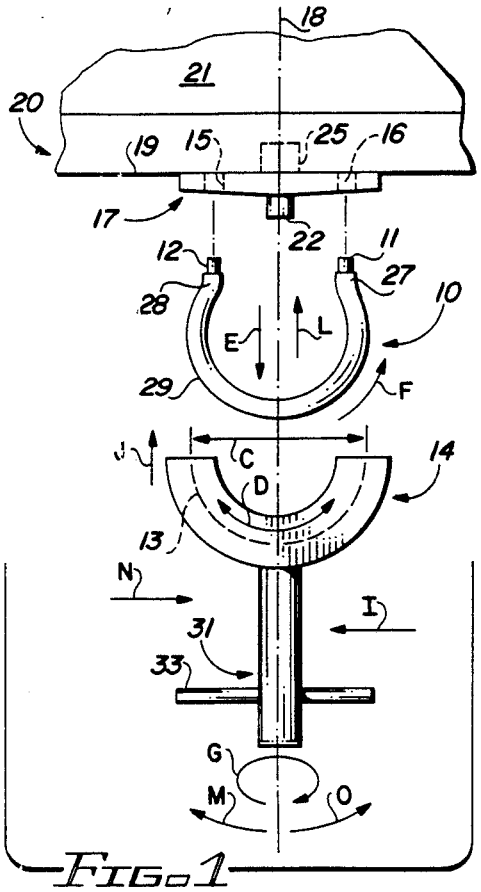
FIG. 1 is an exploded elevation view illustrating cleat installation and removal apparatus constructed in accordance with the principles of the invention.
Figure 2:
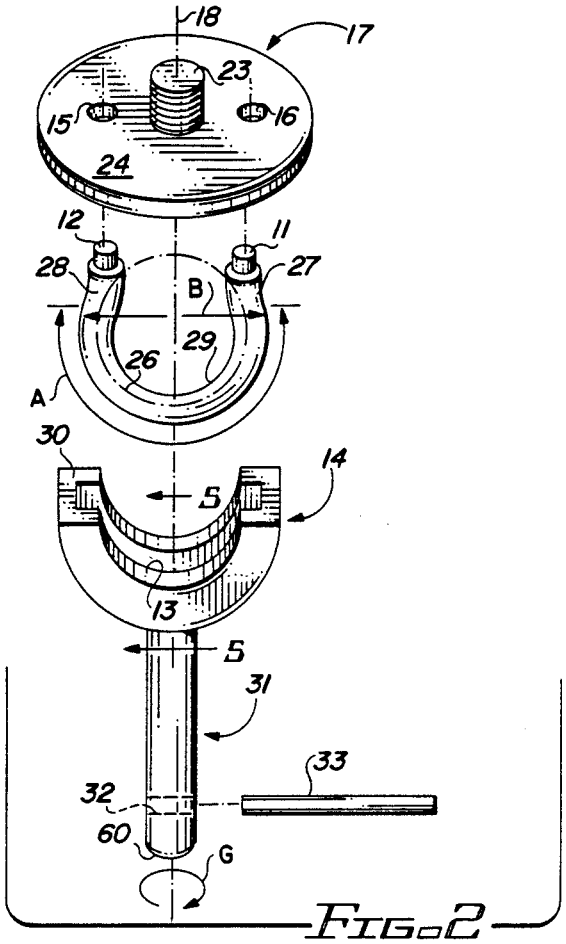
FIG. 2 is an exploded perspective view further illustrating the apparatus of FIG. 1.

Turning now to the drawings, which depict the presently preferred embodiments and best mode of the invention for the purpose of illustrating the practise thereof and not by way of limitation of the scope of the invention and in which like reference characters represent corresponding elements throughout the several views, FIGS. 1, 2, 4, and 5 illustrate apparatus constructed in accordance with one presently preferred embodiment of the invention. The apparatus includes cleat engaging structure 10 provided with feet 11 and 12. Structure 10 is slidably received by groove 13 formed in U-shaped body 14. Feet 11 and 12 are sized to fit into and be received by apertures 15 and 16 formed through cleat 17. Each aperture 15, 16 is equidistant from axis 18 and is colinear with tip 22. Axis 18 is perpendicular to bottom surface 19 of the sole 20 of shoe 21 and passes through the ground engaging tip 22 of cleat 17. Externally threaded screw 23 is affixed to and outwardly extends from the back surface 24 of cleat 17. Screw 23 turns into internally threaded aperture 25 formed in the sole 20 of shoe 21. Feet 11 and 12 are connected to the U-shaped peripheral portion 29 of cleat engaging structure 10. The lower part of the peripheral portion 29 of structure 10 indicated by arrows A in FIG. 2 has a circular center line 26. The upper parts 27 and 28 of the peripheral portion 29 of structure 10 are, as shown in FIG. 2, outwardly bent or formed from center line 26. The outer diameter, indicated by arrows B, of the lower part 29 of the peripheral portion of structure 10 is slightly smaller than the diameter, indicated by arrows C, of U-shaped semi-circular groove 13 such that lower part 29 is slidably received by groove 13. Once lower part 29 is seated in and contacting groove 13, structure 10 can, while body 14 is stationary, be slidably tilted in groove 13 in the directions indicated by arrows D. If structure 10 consisted of a complete ring, the entire outer surface of structure 10 could be slidably rotated through groove 13 in the directions indicated by arrows D. The outwardly turned upper parts 27 and 28 of structure 10 prevent, however, parts 27 and 28 from being slidably turned into groove 13. In other words, after lower part 29 in FIG. 1 is moved directly downwardly in the direction of arrow E to contact and seat in groove 13, and after lower part 29 is slidably moved over groove 13 in the direction of arrow F, upper part 28 comes into contact with end surface 30 and is prevented from moving into groove 13.

Cylindrical neck 31 is attached to body 14. Cylindrical aperture 32 formed through neck 32 slidably receives cylindrical pin 33. Pin 33 is manually grasped and turned to rotate neck 31, body 14, and lower part 29 seated in groove 13 in the direction of arrow G.

Figure 5:
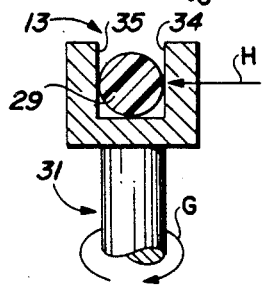
FIG. 5 is a side section view illustrating the mode of operation of the apparatus of the invention and taken along section line 5—5 in FIG. 2.

FIG. 5 illustrates a section view of groove 13 and lower part 29 when lower part 29 is seated in groove 13. Rotating neck 31 in the direction of arrow G produces a force, indicated by arrow H against lower part 29. Inner wall 34 of groove 13 presses against lower part 29 to produce the force indicated by arrow H. The force indicated by arrow H is transverse axis 18.

In FIG. 1, cleat engaging structure 10 can be downwardly displaced in the direction of arrow E to seat lower portion 29 in groove 13. If, after structure 10 has been so seated in groove 13, structure 10 remains stationary and a force, indicated by arrow I is applied to neck 31 then groove 13 slides over lower part 29 in the direction indicated by arrow J. Groove 13 will continue to slide over lower part 29, and body 14 and neck 31 will continue to tilt with respect to axis 18 and sole 20, until surface 30 contacts upper part 28.

Figure 6:
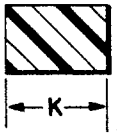
FIG. 6 is a section view of an alternate embodiment of the cleat engaging structure utilized in the practise of the invention.

The cross-sectional area of lower part 29 is, as shown in FIG. 5, circular. Lower part 29 can, if desired, be formed with the rectangular cross-sectional area illustrated in FIG. 6. In FIG. 6, the width, indicated by arrows K, is preferably slightly less than the width, indicated by arrows L in FIG. 4, of groove 13. This permits a lower part 29 with the rectangular cross section of FIG. 6 to be slidably received by groove 13. A lower part 29 with the rectangular cross section of FIG. 6 would still have the outer diameter indicated by arrows B in FIG. 2.

In use, lower part 29 of structure 10 is seated in groove 13 by manually or otherwise displacing structure 10 in the direction of arrow E in FIG. 1. FIG. 5 is a cross-sectional view taken along section lines 5—5 of FIG. 2 after lower part 29 is seated in groove 13. Once part 29 is seated in groove 13, handle 31 and pin 33 are manually grasped by the user and body 14 and structure 10 are simultaneously displaced in the direction of arrow L in FIG. 1 until feet 11 and 12 are inserted in apertures 16 and 15, respectively. The user rotates pin 33 and handle 31 in the direction of arrow G to simultaneously cause body 14 to rotate. When body 14 rotates, the inner walls 34 and 35 contact and produce lateral forces on lower part 29. These lateral forces, like the lateral force indicated by arrow H in FIG. 5, are transverse axis 18. The lateral forces produced by body 14 against lower part 29 are transmitted to feet 11 and 12. Feet 11 and 12 produce lateral forces against apertures 15 and 16 to cause externally threaded screw 23 of cleat 17 to turn into internally threaded aperture 25. If, while handle 31 is being manually rotated in the direction of arrow G, the user inadvertently pulls handle 31 in the direction of arrow I, groove 13 slides over lower part 29 in the direction of arrow J. The ability of groove 13 to move over lower part 29 in the direction of arrow J is important because when the transverse force indicated by arrow I is applied to handle 31, groove 13 slides over lower part 29 and permits handle 31 and body 14 to tilt in the direction of arrow M without causing foot 11 to lift outwardly free from aperture 16. Similarly, if the transverse force indicated by arrow N is applied to handle 31, groove 13 slides over lower part 29 in the direction of arrow F and permits handle 31 and the body 14 to tilt in the direction of arrow 0 without causing foot 12 to lift outwardly free from aperture 15. When handle 31 and body 14 tilt in the direction of arrow M or arrow O, body 14 moves along an arcuate path of travel indicated by arrows D. The arcuate path of travel indicated by arrows D lies in a flat plane which extends through axis 18 and apertures 15 and 16.

Figure 3:
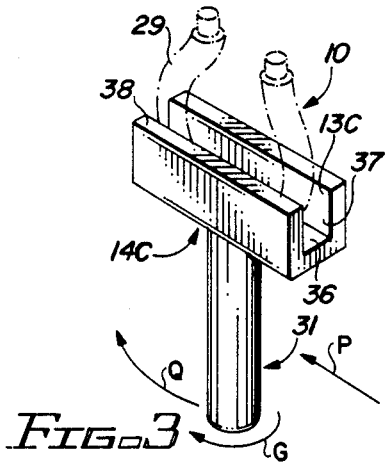
FIG. 3 is a perspective view illustrating apparatus constructed in accordance with an alternate embodiment of the invention.

In the practice of the invention, it is desired that when a transverse force such as the forces indicated by arrow N or arrow I is applied to handle 31, handle 31 and body 14 will move over structure 10 without causing feet 11 and 12 to lift free from apertures 15 and 16. Further, while body 14 moves or tilts with respect to structure 10, it is important that body 14 maintain contact with structure 10 such that rotating handle 31 in the direction of arrow G (or in a direction opposite that indicated by arrow G) causes structure 10, and consequently cleat 17, to rotate about axis 18. Accordingly, in the alternate embodiment of the invention illustrated in FIG. 3 groove 13A has a flat planar bottom 36 and sides 37 and 38. When a lateral force P is applied to handle 31 groove 13C can roll or move over lower portion 29 of stationary structure 10 in the direction of arrow Q. While body 14C moves over structure 10 in the direction of arrow Q, groove 13C maintains contact with structure 10 such that rotating handle 31 in the direction of arrow G causes structure 10 to rotate.

Figure 7:
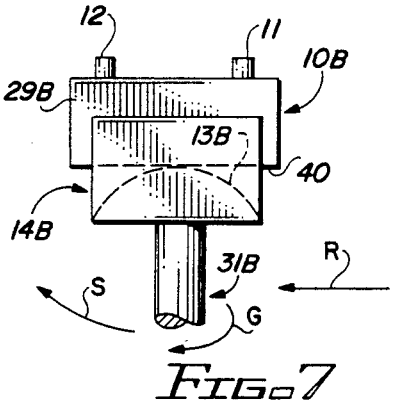
FIG. 7 is a side view illustrating another alternate embodiment of the invention; and, FIG. 8 is a perspective view illustrating an alternate cleat engaging structure.

In the embodiment of the invention depicted in FIG. 7 cleat engaging structure 10B includes lower part 29B. Part 29B includes planar rectangular lower edge 40. Edge 40 can, if desired, be concave and slidably conform to the convex surface of groove 31B. Body 14B includes groove 13B which receives lower portion 19B. When the transverse force indicated by arrow R is applied to handle 31B, handle 31B tilts in the direction of arrow S. Handle 31B tilts in the direction of S because the concave floor of groove 13B rolls over the flat planar lower edge 40 of stationary structure 10B. While handle 31B is tilting in the direction of arrow S, handle 31B can be rotated in the direction of arrow G to rotate structure 10B in the direction of arrow G.

Figure 8:
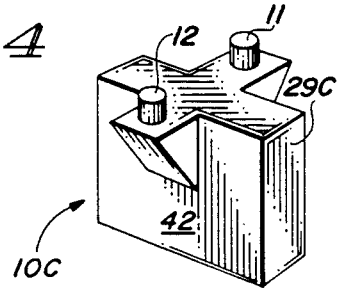

An alternate cleat engaging structure 10C is depicted in FIG. 8 and includes feet 11 and 12 mounted transverse the plane which passes through rectangular face 42 of lower part 29C.

Figure 4:
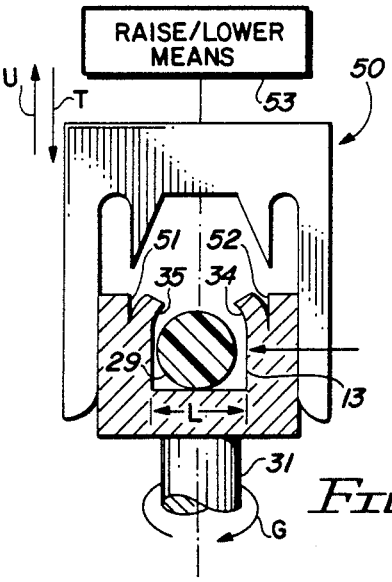
FIG. 4 is a side section view illustrating a crimping tool which can be utilized in the practice of the invention.

The crimping tool 50, shown in FIG. 4, can be utilized to inwardly displace the upper portions of inner walls 34 and 35 in the manner shown. In FIG. 4, raise-lower means 53 has been utilized to displace tool 50 in the direction of arrow T to form notches 51 and 52 to inwardly displace upper portions of inner walls 34 and 35 to prevent lower part 29 from being lifted out of groove 13 in the direction of arrow U. After tool 50 is downwardly displaced in the direction of arrow T to form notches 51 and 52, means 53 raises tool 50 in the direction of arrow U to the position shown in FIG. 4.

In addition to being manually rotatable, neck 31 can be rotated by inserting lower end 60 in the chuck of a electric drill. The electric drill is then operated to impart motive power to neck 31 to rotate neck 31 in the direction of arrow G or in a direction opposite arrow G. Any other desirable motive power means can be utilized to turn neck 31, body 14, structure 10 and, consequently, cleat 17.

The distance along the arcuate path of travel indicated by arrows D which said groove 13 and body 14 can move will vary depending on the shape and dimension of body 14, groove 13 and structure 10. A principal advantage of the apparatus of the invention is, however, that groove 13 and body 14 can move over structure 10 some selected distance to compensate for lateral forces I and N to prevent a foot 11, 12 from lifting free from engagement with an aperture 16, 15.

Feet 11 and 12 can be shaped and dimensioned in any manner which enables feet 11 and 12 to engage cleat 17 such that cleat 17 rotates when structure 10 and feet 11, 12 are rotated about axis 18.

Having described my invention in such terms as to enable those skilled in the art to understand and practise it, and having identified the presently preferred embodiments thereof, I claim:

1. In combination with a shoe including at least one cleat rotatably affixed to the sole of said shoe, said cleat being rotated in a first plane about a selected axis of rotation when being secured to said sole and including a pair of apertures each spaced away from said axis and opening outwardly from said sole, said axis being at an angle to said sole, said plane being substantially parallel to said sole, the improvement comprising tool means for turning said cleat, said tool means including (a) a cleat engaging structure including (i) a pair of feet each received by a different one of said pair of cleat apertures, and, (ii) a peripheral portion connected to said feet;

(b) a body including a groove slidably receiving at least a part of said peripheral portion, said cleat engaging structure being movable to a first operative position when said pair of feet are each received by a different one of said pair of cleat apertures, said body, when said cleat engaging structure is in said first operative position, being slidable along said peripheral portion to a second operative position in which said axis passes through said body and said body straddles said axis; and, (c) torque means for applying a torque to said body to rotate said feet about said selected axis to turn said cleat;

said groove being shaped and dimensioned such that (d) turning said body about said selected axis presses at least a portion of said groove against said part of said peripheral portion to generate forces transverse said axis and acting against said part of said peripheral portion to generate twisting forces on (i) said cleat engaging structure, and (ii) through said feet, on said pair of apertures and said cleat;

(e) said groove contacts and can slidably move over said peripheral portion a selected distance along an arcuate path of travel lying in a flat second plane such that said body can tilt with respect to said sole and said cleat engaging structure while said feet remain in said apertures, said flat second plane being at an angle with respect to said sole and being generally parallel to said selected axis of rotation; and, (f) said torque means can apply a torque to said body simultaneously with the sliding movement of said groove over said peripheral portion.

* * * * *